United States Patent [19]

Prairie et al.

[11] Patent Number: 4,706,900

[45] Date of Patent: Nov. 17, 1987

[54] RETROFITABLE COILED SPRING SYSTEM

[75] Inventors: Robert S. Prairie; Frank J. Paskowski, Jr., both of Pittsfield, Mass.

[73] Assignee: Combustion Engineering, Inc., Windsor, Conn.

[21] Appl. No.: 765,976

[22] Filed: Aug. 15, 1985

[51] Int. Cl.[4] ..... B02C 15/00

[52] U.S. Cl. ..... 241/121; 241/289; 267/137

[58] Field of Search ..... 241/117–121, 241/287–290, 37, 101.2; 267/89, 137, 140.2, 136, 170, 172, 174–177, 179

[56] References Cited

U.S. PATENT DOCUMENTS

| | | | |
|---|---|---|---|
| 810,830 | 1/1906 | Wegerif | 241/121 |
| 2,532,092 | 11/1950 | Frangquist | 241/121 X |
| 3,881,348 | 5/1975 | Morton | 241/121 X |
| 4,372,496 | 2/1983 | Maliszewski | 241/121 X |

*Primary Examiner*—Mark Rosenbaum

*Attorney, Agent, or Firm*—Arthur E. Fournier, Jr.

[57] ABSTRACT

A coiled spring system (20) particularly suited for use in a bowl mill (10) of the type that is employed for purposes of effectuating therewithin the pulverization of material such as coal. It is through the operation of the subject coiled spring system (20) that there is established the magnitude of the forces which the grinding rolls (18) of the bowl mill (10) apply to the coal for purposes of accomplishing the pulverization of the coal. The subject coiled spring system (20) includes stud bearing housing means (36), preload stud means (38) suitably supported from the stud bearing housing means (36), pressure spring means (40) positioned in surrounding relation to the preload means (38), and spring housing means (42) encircling the pressure spring means (40).

4 Claims, 2 Drawing Figures

RETROFITABLE COILED SPRING SYSTEM

CROSS-REFERENCE TO RELATED APPLICATIONS

This application is hereby cross-referenced to the following patent application which was commonly filed herewith and which is commonly assigned: U.S. Pat. application Ser. No. 765,776 filed Aug. 15, 1985 entitled "SUPERMILL JOURNAL SPRING ASSEMBLY" and which was filed in the name of Robert S. Prairie.

BACKGROUND OF THE INVENTION

This invention relates to apparatus for pulverizing, i.e., grinding, material, and more specifically to a coiled spring system that is particularly suited for embodiment in a bowl mill wherein the coiled spring system is operative for purposes of establishing the magnitude of the forces which the grinding rolls of the bowl mill exert on the coal for purposes of effectuating the pulverization of the coal.

An essential component of any steam generation system of the type, which utilizes pulverized coal as a fuel, is the apparatus in which the coal is pulverized so as to render it suitable for such usage. Although the prior art is known to have employed various types of apparatus for purposes of accomplishing coal pulverization, one form of apparatus in particular, which has frequently been used for this purpose, is that commonly referred to as a bowl mill by those in the industry. The bowl mill obtains its name principally from the fact that the pulverization, i.e., grinding, of the coal that takes place therewithin occurs on a grinding surface which in configuration somewhat resembles a bowl.

By way of illustration, reference may be had to U.S. Pat. No. 3,465,971 which issued Sept. 9, 1969 to J. F. Dalenberg et al. and which is assigned to the same assignee as the present invention for a showing of a prior art form of bowl mill. This patent contains a teaching of both the nature of the construction and the mode of operation of a bowl mill that is suitable for use for purposes of effectuating the pulverization of the coal that is used to fuel a coal-fired steam generator. As taught by this patent, the essential components of such a bowl mill are a body portion, i.e., housing, within which a grinding table is mounted for rotation, a plurality of grinding rolls that are supported in equally spaced relation one to another in a manner so as to coact with the grinding table such that the coal disposed on the surface of the grinding table is capable of being ground, i.e., pulverized, by the rolls, coal supply means for feeding to the surface of the grinding table the coal that is to be pulverized in the bowl mill, and air supply means for providing to the interior of the body portion the air that is required for the operation of the bowl mill.

In order to satisfy the demands of a coal-fired steam generation system of conventional construction for pulverized coal a multiplicity of bowl mills of the type shown in the aforereferenced patent are commonly required to be employed. Further in this regard, it is noted that the individual capacity of each of these bowl mills may range up to a capacity of one hundred tons of pulverized coal per hour. In addition to possessing a capability of operating at their maximum capacity, these bowl mills must also have the ability to operate at less than full capacity, i.e., at some percentage thereof, e.g., 25%, 50%, 75%, etc. Accordingly, this fosters a further requirement that the bowl mill be capable of exerting the requisite degree of grinding force regardless of the rate of output at which the bowl mill is operating. Here note is taken of the fact that variations in the output provided from the bowl mill are normally accomplished by varying the amount of coal that is fed to the grinding table, while the speed of rotation of the grinding table is made to remain substantially constant.

The depth of coal that is disposed on the grinding table is a function of the output rate at which the bowl mill is performing. In addition, the depth of coal that is present on the grinding table has an effect on the amount of grinding force being exerted on the coal by the grinding rolls. Obviously, therefore, it is important that if the grinding rolls are to apply the requisite degree of force needed to effect the pulverization of the coal, consideration must be given to the existence of this relationship between the grinding force exerted by the grinding rolls and the depth of coal on the grinding table.

The journal loading, which dictates the amount of grinding force that the grinding rolls exert on the coal, has heretodate been provided either through the use of hydraulic systems or through the use of mechanical springs. One such arrangement of mechanical springs can be found depicted, for example, in the patent which was referred to above previously. In accord with a showing contained in this U.S. patent, each grinding roll is urged towards the surface of the grinding table by means of an adjustable spring. To this end, there is selected for use for this purpose, a mechanical coil spring that possesses the design characteristics desired; namely, a spring that is capable of urging the grinding roll toward the grinding table surface in such a manner that the grinding roll exerts a predetermined grinding force on the coal disposed on the table, when the coal is of a predetermined depth on the table.

As an alternative to the use of mechanical coil springs for purposes of providing the journal loading, the prior art on occasion has turned to the employment of hydraulic systems. U.S. Pat. No. 4,002,299, which issued on Jan. 11, 1977 to C. J. Skalka and which is assigned to the same assignee as the present application, is directed to one arrangement of such a hydraulic system. In accord with the teachings of this patent, a system is provided wherein grinding rolls have a hydraulic loading applied thereto. More specifically, the hydraulic loading on the grinding rolls is established by means of hydraulic fluid that is fed under pressure to the grinding rolls. Moreover, through the use of a servo system, changes in the hydraulic pressure are automatically effected as the mill output increases or decreases.

Whether the journal loading is accomplished in a bowl mill by means of a hydraulic system or by means of a mechanical spring system is commonly determined before the bowl mill is manufactured. Furthermore, once the bowl mill has been manufactured with a particular form of journal loading system, this is the form of journal loading system that the bowl mill embodies during the remainder of its useful life. Namely, the conventional practice has been one in which a bowl mill which at the time of its original manufacture was made to embody, for example, a hydraulic journal loading system will always embody a hydraulic journal loading system. On the other hand, situations have been known to have arisen in which it would have been desirable to replace one form of journal loading system with another form of journal loading system. More specifically, in the case of a number of the more recent of such instances it would have been desirable to be able to replace a hydraulic journal loading system with a mechanical spring system. However, heretodate, primarily because of the basic nature of the differences, both in terms of the nature of the construction and the mode of operation thereof, that has existed between a hydraulic journal loading system and a mechanical spring journal loading system the owner of the bowl mill has not had available to him the option of being able to replace a hydraulic system with a mechanical spring system. A need has thus been evidenced for a new and improved form of coiled spring system which could be utilized in a bowl mill as a journal loading system, but which most importantly would be capable of being utilized as a retrofit for a hydraulic journal loading system in a bowl mill.

It is, therefore, an object of the present invention to provide a new and improved system operable for establishing the journal loading on the grinding rolls of a bowl mill that is suitable for use to pulverize coal.

It is another object of the present invention to provide such a system that is operative to establish a mechanical spring journal loading on the grinding rolls of a bowl mill suitable for use to pulverize coal.

It is still another object of the present invention to provide such a mechanical spring system for establishing the journal loading on the grinding rolls of a bowl mill that is capable of being utilized as a retrofit for a hydraulic journal loading system in an existing bowl mill.

A further object of the present invention is to provide such a mechanical spring system for establishing the journal loading on the grinding rolls of a bowl mill that is characterized by the fact that lower forces are exerted thereby on the lower main vertical shaft of the bowl mill.

A still further object of the present invention is to provide such a mechanical spring system for establishing the journal loading on the grinding rolls of a bowl mill that is characterized by the fact that the spring portion thereof is suitably positioned such that minimal influence is exerted thereupon by the operating conditions which exist within the bowl mill.

Yet another object of the present invention is to provide such a mechanical spring system for establishing the journal loading on the grinding rolls of a bowl mill that is characterized by the fact that less maintenance is required thereby.

Yet still another object of the present invention is to provide such a mechanical spring system for establishing the journal loading on the grinding rolls of a bowl mill that is relatively simple to manufacture and operate, as well as being relatively inexpensive to provide.

SUMMARY OF THE INVENTION

In accordance with the present invention there is provided a mechanical spring system that is particularly suited for employment in a bowl mill of the type that is operative for purposes of effecting the pulverization therewithin of a material such as coal. The subject mechanical spring system is operative for purposes of establishing the journal loading on the grinding rolls of the bowl mill through the operation of which in turn the pulverization of the coal is accomplished within the bowl mill. The subject mechanical spring system includes stud bearing housing means, preload stud means, pressure spring means and spring housing means. The stud bearing housing means is suitably secured to the journal opening cover of the bowl mill so as to be located within the interior of the bowl mill and in juxtaposed relation to an opening with which the bowl mill is suitably furnished that provides access from the interior to the exterior of the bowl mill. The preload stud means is suitably supported from the stud bearing housing means so as to be positioned within the aforementioned opening and such as to protrude from the interior to the exterior of the bowl mill. The pressure spring means is positioned in surrounding relation to the preload stud means such that the pressure spring means is located externally of the bowl mill. The spring housing means encircles the pressure spring means and is suitably secured to the journal opening cover of the bowl mill so as to be located on the outside of the bowl mill.

DESCRIPTION OF A PREFERRED EMBODIMENT

Figure 1:
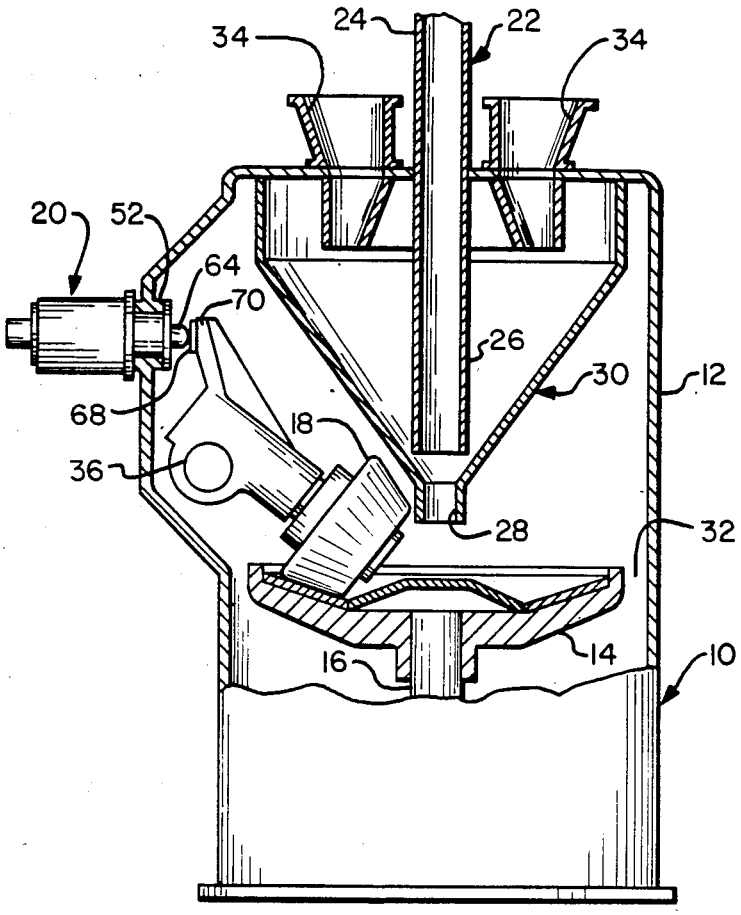
FIG. 1 is a side elevational view partially in section of a pulverizer bowl mill equipped with a mechanical coil spring journal loading system constructed in accordance with the present invention.

Referring now to the drawing, and more particularly to FIG. 1 thereof, there is depicted therein a pulverizing bowl mill, generally designated by reference numeral 10. Inasmuch as the nature of the construction and the mode of operation of pulverizing bowl mills per se are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, which is equipped with a mechanical coil spring journal loading system constructed in accordance with the present invention, that there be presented herein merely a description of the nature of the construction and the mode of operation of the components of the pulverizing bowl mill 10 with which the aforesaid mechanical coil spring journal loading system cooperates. For a more detailed description of the nature of the construction and the mode of operation of the components of the pulverizing bowl mill 10, which are not described in detail herein, one may have reference to the prior art, e.g., U.S. Pat. No. 3,465,971, which issued on Sept. 9, 1969 to J. F. Dalenberg et al., and/or U.S. Pat. No. 4,002,299, which issued on Jan. 11, 1977 to C. J. Skalka.

Referring further to FIG. 1 of the drawing, the pulverizing bowl mill 10 as illustrated therein includes a substantially closed separator body 12. A grinding table 14 is mounted on a shaft 16, which in turn is operatively connected to a suitable drive mechanism (not shown) so as to be capable of being suitably driven thereby. With the aforesaid components arranged within the separator body 12 in the manner depicted in FIG. 1 of the drawing, the grinding table 14 is designed to be driven in a clockwise direction.

Continuing with a description of the pulverizing bowl mill 10, a plurality of grinding rolls 18, preferably three in number in accord with conventional practice, are suitably supported within the interior of the separator body 12 so as to be equidistantly spaced one from another around the circumference of the separator body 12. In the interest of maintaining clarity of illustration in the drawing, only one such grinding roll 18 has been shown in FIG. 1. With further regard to the grinding rolls 18, each of the latter as best understood with reference to FIG. 1 of the drawing is preferably supported on a suitable shaft (not shown) for rotation relative thereto. Further, the grinding rolls 18 are each suitably supported in a manner yet to be described for movement relative to the upper surface, as viewed with reference to FIG. 1, of the grinding table 14. To this end, each of the grinding rolls 18 has a mechanical coil spring system, generally designated in FIG. 1 by reference numeral 20, cooperatively associated therewith. Each of the mechanical coil spring systems 20 is operative, as will be described more fully hereinafter, to establish a mechanical spring loading on the corresponding grinding roll 18 whereby the latter may be made to exert the requisite degree of force on the coal that is disposed on the grinding table 14 for purposes of accomplishing the desired pulverization of this coal. The manner in which and the means by which the spring loading on the grinding rolls 18 is accomplished by the mechanical coil spring systems 20 comprises the subject matter which forms the essence of the present invention, and is described in detail herein subsequently.

The material, i.e., coal, that is to be pulverized in the bowl mill 10 is fed thereto through the use of any suitable conventional type of feeding means such as a belt feeder (not shown). Upon falling free of the belt feeder (not shown), the coal enters the bowl mill 10 by means of a coal supply means, generally designated by reference numeral 22, with which the separator body 12 is suitably provided. In accordance with the embodiment of the pulverizing bowl mill 10 illustrated in FIG. 1, the coal supply means 22 includes a suitably dimensioned duct 24 having one end thereof which extends outwardly of the separator body 12 and preferably terminates in a funnel-like member (not shown). The latter funnel-like member (not shown) is suitably shaped so as to facilitate the collection of the coal particles leaving the belt feeder (not shown), and the guiding thereafter of these coal particles into the duct 24. The other end 26 of the duct 24 of the coal supply means 22 is operative to effect the discharge of the coal onto the surface of the grinding table 14. To this end, as shown in FIG. 1 of the drawing, the duct end 26 preferably is suitably supported within the separator body 12 through the use of any suitable form of conventional support means (not shown) such that the duct end 26 is coaxially aligned with the shaft 16, and is located in spaced relation to a suitable outlet 28 provided in the classifier, generally designated by reference numeral 30, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air provided for this purpose enters the separator body 12 through a suitable opening (not shown) provided therein for this purpose. From the aforesaid opening (not shown) in the separator body 12 the air flows to a multiplicity of annular spaces 32 suitably formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for use for this purpose in the bowl mill 10 of FIG. 1, comprises the subject matter of U.S. Pat. No. 4,234,132, which issued on Nov. 18, 1980 to T. V. Maliszewski, Jr., and which is assigned to the same assignee as the present application.

While the air is flowing along the path described above, the coal which is disposed on the surface of the grinding table 14 is being pulverized by the action of the grinding rolls 18. As the coal becomes pulverized, the particles are thrown outwardly by centrifugal force away from the center of the grinding table 14. Upon reaching the area of the circumference of the grinding table 14, the coal particles are picked up by the air exiting from the annular spaces 32 and are carried along therewith. The combined flow of air and coal particles is thereafter captured by the deflector means (not shown), which has been referred to previously hereinabove. The effect of this is to cause the combined flow of air and coal particles to be deflected over the grinding table 14. This necessitates a change in direction in the path of flow of this combined stream of air and coal particles. In the course of effecting this change of direction, the heaviest coal particles, because they have more inertia, become separated from the airstream and fall back onto the circumference of the grinding table 14 whereupon they undergo further pulverization. The lighter coal particles, on the other hand, because they have less inertia continue to be carried along in the airstream.

After leaving the influence of the aforesaid deflector means (not shown) the combined stream of air and coal particles that remain flow to the classifier 30 to which mention has previously been had herein. The classifier 30, in accord with conventional practice and in a manner which is well-known to those skilled in this art, operates to effect a further sorting of the coal particles that remain in the airstream. Namely, those particles of pulverized coal, which are of the desired particle size, pass through the classifier 30 and along with the air are discharged therefrom and thereby from the bowl mill 10 through the outlets 34 with which the latter is provided for this purpose. On the other hand, those coal particles which in size are larger than desired are returned to the surface of the grinding table 14 whereupon they undergo further pulverization. Thereafter, these coal particles are subject to a repeat of the process described above. That is, the particles are thrown outwardly of the grinding table 14, are picked up by the air exiting from the annular spaces 32, are carried along with the air to the deflector means (not shown), are deflected back over the grinding table 14 by the deflector means (not shown), the heavier particles drop back on the grinding table 14, the lighter particles are carried along to the classifier 30, those particles which are of the proper size pass through the classifier 30 and exit from the bowl mill 10 through the outlets 34.

With further regard to the matter of the pulverizing action to which the coal disposed on the upper surface of the grinding table 14, as viewed with reference to FIG. 1, is subjected by the grinding rolls 18, the amount of force that must be exerted by the latter in order to effect the desired degree of pulverization of the coal will vary depending on a number of factors. Simply stated, the amount of force that the grinding rolls 18 must exert in order to accomplish the desired pulverization of the coal can be said to be principally a function of the amount, i.e., depth, of coal that is present on the grinding table 14. In turn, the amount of coal which is disposed on the grinding table 14 is a function of the output rate at which the bowl mill 10 is being operated to produce pulverized coal.

As best understood with reference to FIG. 1 of the drawing, the amount of grinding force which the grinding rolls 18 apply to the coal on the grinding table 14 is a function of the amount of force with which the grinding rolls 18 are biased into engagement with the coal on the table 14. Moreover, in accord with the nature of the construction shown in FIG. 1, the grinding roll 18 depicted therein, which is suitably mounted for rotation on a shaft (not shown), is suitably supported so as to be pivotable about the pivot pin 36 into and out of engagement with the coal that is disposed on the grinding table 14. Although only one grinding roll 18 is shown in FIG. 1 and although this discussion is directed to this one grinding roll 18, it is to be understood that the bowl mill 10 commonly is provided with a plurality of such grinding rolls 18, e.g., preferably three in number, and that this discussion is equally applicable to each of the plurality of grinding rolls 18.

Continuing with the matter of the force exerted by the grinding roll 18, in accord with the nature of the construction illustrated in FIG. 1, the grinding roll 18 is designed to be biased by spring force into and out of engagement with the coal that is on the grinding table 14. More specifically, in accord with the present invention, and as will now be described, the spring force to which the grinding roll 18 is subjected is applied thereto by the mechanical coil spring system 20, the nature of the construction and the mode of operation of which comprises the subject matter that forms the essence of the present invention. To this end, the bowl mill 10 embodies a plurality of new and improved mechanical coil spring systems 20. That is, in accord with the best mode embodiment of the invention each of the three grinding rolls 18 with which the bowl mill 10 is provided has cooperatively associated therewith a new and improved mechanical coil spring system 20. However, inasmuch as the three mechanical coil spring systems 20 are each identical in construction and in mode of operation, it has been deemed sufficient for purposes of obtaining an understanding thereof as well as in the interest of maintaining clarity of illustration in the drawing to show only one of the three mechanical coil spring systems 20 in FIG. 1 of the drawing.

Figure 2:
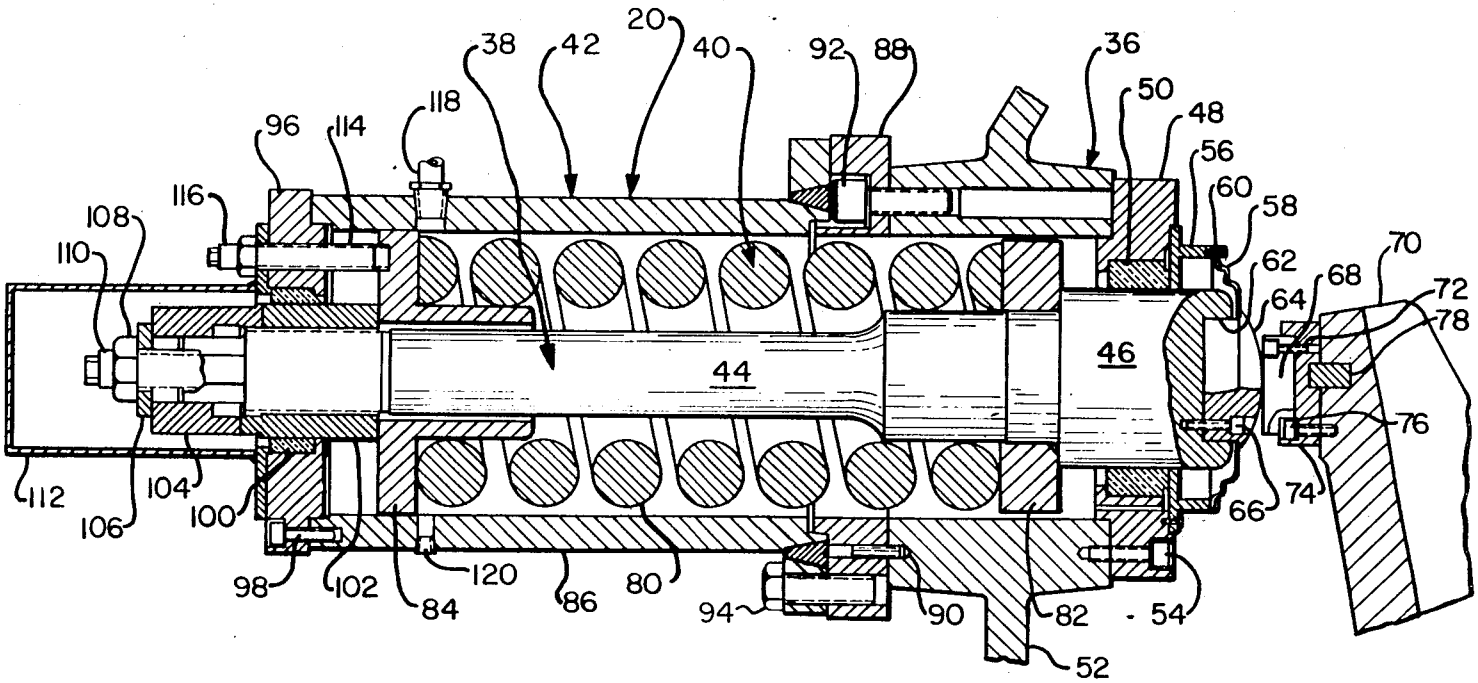
FIG. 2 is a side elevational view partially in section of a mechanical coil spring journal loading system constructed in accordance with the present invention.

Turning now to a detailed consideration of the nature of the construction of the mechanical coil spring system 20, reference will be had for this purpose in particular to FIG. 2 of the drawing. As depicted therein, the mechanical coil spring system 20 is seen to include the following major components: a stud bearing housing means, generally designated by the reference numeral 36; a preload stud means, generally designated by the reference numeral 38; a pressure spring means, generally designated by the reference numeral 40; and a spring housing means, generally designated by the reference numeral 42.

Commencing first with a description of the preload stud means 38, the latter as best understood with reference to FIG. 2 of the drawing includes a spring preload stud which is identified in FIG. 2 by the reference numeral 44. The spring preload stud 44 is suitably dimensioned so as to extend substantially the entire length of the mechanical coil spring system 20. Moreover, the spring preload stud 44 is provided with shoulder-like portions for a purpose which will become more readily apparent from the description that follows. Finally, the spring preload stud 44 has suitably formed at one end thereof an enlarged portion 46. With the spring preload stud 44 positioned within the mechanical coil spring system 20 in the manner depicted in FIG. 2 of the drawing, the enlarged portion 46 of the spring preload stud 44 is designed to protrude outwardly of the mechanical coil spring system 20 as will be described more fully hereinafter.

The mounting as shown in FIG. 2 of the spring preload stud 44 within the mechanical coil spring system 20 is accomplished through the operation of the stud bearing housing means 36. To this end, and as will be best understood with reference to FIG. 2 of the drawing, the stud bearing housing means 36 includes a stud bearing housing, which has been identified in FIG. 2 by the reference numeral 48. Moreover, as seen in FIG. 2, the stud bearing housing 48 is suitably positioned relative to the spring preload stud 44 so as to encircle the enlarged portion 46 of the spring preload stud 44. More specifically, in accord with the best mode embodiment of the invention, a spring stud bearing 50 is interposed between the outer surface of the enlarged portion 46 of the spring preload stud 44 and the inner surface of the stud bearing housing 48 such that with the stud bearing housing 48 positioned in the manner depicted in FIG. 2 of the drawing, the spring stud bearing 50 is held captured between the enlarged portion 46 of the spring preload stud 44 and the stud bearing housing 48. The stud bearing housing 48 in turn is fastened to the journal opening cover, the latter being denoted in FIG. 2 by the reference numeral 52, of the bowl mill 10 through the use of any suitable form of conventional fastening means such as threaded fasteners, one of which can be seen depicted at 54 in FIG. 2 of the drawing.

Continuing with the description of the mechanical coil spring system 20 as shown in FIG. 2 of the drawing, the enlarged portion 46 of the spring preload stud 44 further has positioned in encircling relation thereto a seal mounting plate, the latter being identified in FIG. 2 by the reference numeral 56. Cooperatively associated with the seal mounting plate 56 is a diaphragm seal 58. To this end, in accordance with the best mode embodiment of the invention the cooperative association of the diaphragm seal 58 with the seal mounting plate 56 is accomplished by means of an assembly consisting of a seal retaining ring (not shown), a seal inner collar (not shown) and a seal outer ring (not shown). Moreover, the interengagement of the aforereferenced assembly with the diaphragm seal 58 and the seal mounting plate 56 preferably is accomplished through the use of any suitable form of conventional fastening means such as threaded fasteners, one of which can be seen at 60 in FIG. 2 of the drawing.

As will be understood with reference to FIG. 2 of the drawing, the enlarged portion 46 of the spring preload stud 44 is suitably provided at the outermost end thereof with a cavity, which is to be found identified in FIG. 2 by the reference numeral 62. The latter cavity 62 moreover is suitably dimensioned so as to be capable of receiving therewithin a spring stud insert 64. For purposes of retaining the spring stud insert 64 within the cavity 62, any suitable form of conventional fastening means may be employed such as threaded fasteners, one of which is seen at 66 in FIG. 2. The spring stud insert 64 is designed to interact with a journal head insert 68. To this end, the journal head insert 68 is suitably mounted on the journal head, the latter being designated in FIG. 2 by the reference numeral 70, of the bowl mill 10. More specifically, the journal head insert 68 is suitably fastened, preferably by threaded fasteners, one of which can be seen at 72 in FIG. 2, to a journal head adapter 74. The journal head adapter 74 in turn is both keyed and fastened to the journal head 70. Namely, the journal head adapter 74 is fastened to the journal head 70 through the use of any suitable form of conventional fastening means such as threaded fasteners, one of which is depicted at 76 in FIG. 2. Moreover, the journal head adapter 74 is keyed to the journal head 70 by means of the journal head key 78 which as seen with reference to FIG. 2 is suitably interposed between the journal head adapter 74 and the journal head 70.

With further reference to FIG. 2 of the drawing, it will be readily apparent therefrom that positioned in surrounding relation to the spring preload stud 44 of the preload stud means 38 is the pressure spring means 40. More specifically, the pressure spring means 40 includes a journal pressure spring 80 which as shown in FIG. 2 is designed to encircle the spring preload stud 44. In addition, one end of the journal pressure spring 80 is designed to abut against a spring stud adapter identified in FIG. 2 by the reference nuaeral 82, which is suitably dimensioned so as to be positionable on the spring preload stud 44 such that the spring stud adapter 82 abuts against a shoulder formed by the enlarged portion 46 of the spring preload stud 44. The other end of the journal pressure spring 80 abuts against a spring guide 84 that surrounds the spring preload stud 44 adjacent the other end of the latter.

The journal pressure spring 80 in turn is suitably housed within the spring housing means 42. A description will thus now be had of the spring housing means 42. As best understood with reference to FIG. 2 of the drawing, the spring housing means 42 includes a spring housing, the latter being identified by the reference numeral 86 in FIG. 2. Moreover, in accord with the best mode embodiment of the invention, a housing adapter plate, the latter being denoted by the reference numeral 88 in FIG. 2, is preferably positioned in interposed relation between the journal opening cover 52 and the right-hand end, as viewed with reference to FIG. 2, of the spring housing 86. Furthermore, the housing adapter plate 88 is preferably both pinned and fastened to the journal opening cover 52. That is, by means of a dowel pin, the latter being identified in FIG. 2 by the reference numeral 90, the housing adapter plate 88 is pinned to the journal opening cover 52, whereas through the use of any suitable form of conventional fastening means such as threaded fasteners, one of which is depicted at 92 in FIG. 2, the housing adapter plate 88 is fastened to the journal opening cover 52. Any suitable form of conventional fastening means can also be utilized for purposes of securing the right-hand end, as viewed with reference to FIG. 2, of the spring housing 86 to the housing adapter plate 88 such as threaded fasteners, one of which is shown at 94 in FIG. 2.

Continuing with a description of the spring housing means 42, the spring housing 86 at the left-hand end thereof, as viewed with reference to FIG. 2, has secured thereto a spring housing cover, which can be found identified by the reference numeral 96 in FIG. 2. In accord with the illustrated embodiment of the invention, the spring housing cover 96 is fastened to the spring housing 86 by means of threaded fasteners, one of which can be seen at 98 in FIG. 2. Associated with the spring housing cover 96, as will be best understood with reference to FIG. 2, is a cover wear sleeve 100. The latter cover wear sleeve 100 in turn is suitably positioned in surrounding relation to the spring stud lock nut 102, which itself is suitably located in encircling relation to the left-hand end, as viewed with reference to FIG. 2, of the spring preload stud 44.

Also provided at the left-hand end, as viewed with reference to FIG. 2, of the spring preload stud 44 is the stud lock nut keeper 104. More specifically, the stud lock nut keeper 104 is suitably located relative to the spring stud lock nut 102 so as to be in abutting engagement therewith. Cooperatively associated with the stud lock nut keeper 104, as best understood with reference to FIG. 2, is a keeper washer denoted in FIG. 2 by the reference numeral 106, a nut denoted by the reference numeral 108 in FIG. 2 and a lock nut keeper stud 110. Finally, in accord with the best mode embodiment of the invention, the stud lock nut keeper 104 and the other components associated therewith which have been enumerated above are preferably all housed within a stud extension cap, the latter being denoted by the reference numeral 112 in FIG. 2.

For purposes of effectuating adjustments of the journal pressure spring 80, the mechanical coil spring system 20 is suitably provided with a plurality of spring adjusting studs, only one of which has been depicted at 114 in FIG. 2 of the drawing in the interest of maintaining clarity of illustration therein. Each of the plurality of spring adjusting studs 114 is made to pass through the spring housing cover 96 through openings suitably provided therein for this purpose, and has one end thereof suitably threaded into the spring guide 84. Cooperatively associated with each of the spring adjusting studs 114 is a nut 116, the latter being operative to selectively maintain the respective spring adjusting stud 114 in the proper position once the desired adjustment of the journal pressure spring 80 has been accomplished. Namely, rotation of the spring adjusting studs 114 is transmitted to the spring guide 84 and therethrough to the journal pressure spring 80 whereby as the grinding roll 18 wears, engagement is maintained as required between the spring stud insert 64 and the journal head insert 68. That is, as the grinding roll 18 wears the journal pressure spring 80 must be made to move closer to the journal head 70.

Completing the description of the nature of the construction of the mechanical coil spring system 20, which is the subject of the present invention, the mechanical coil spring system 20 preferably has formed in the spring housing 86 thereof a fitting for a seal air hose, the latter being shown at 118 at FIG. 2. Finally, the spring housing 86 also preferably has suitably formed therein a pipe plug, the latter being seen at 120 in FIG. 2.

There will now be set forth a description of the mode of operation of the mechanical coil spring system 20, which forms the subject matter of the present invention, in the context of the operation of the bowl mill 10. For this purpose, reference will be had in particular to FIG. 1 of the drawing. As shown in FIG. 1, the mechanical coil spring system 20 is suitably mounted on the exterior wall surface of the separator body 12, and in particular on the journal opening cover 52. Within the mechanical coil spring system 20, the journal pressure spring 80, as has been described in detail hereinbefore is suitably supported for expansion and contraction therewithin.

Cooperatively associated with the journal pressure spring 80 is the spring stud insert 64, which projects outwardly of the mechanical coil spring system 20. The spring stud insert 64 engages the journal head insert 68, which is suitably affixed to the journal head 70. The journal head 70 in turn comprises a portion of the support means for the grinding roll 18. In a manner well-known to those skilled in the spring biasing art, the journal pressure spring 80 through the spring stud insert 64 exerts a spring biasing force on the journal head insert 68 and thereby to the journal head 70.

Accordingly, the engagement of the spring stud insert 64 with the journal head insert 68 and thereby the journal head 70 is a function of the force being exerted by the journal pressure spring 80. In turn, the extent to which the spring stud insert 64 is biased into engagement with the journal head insert 68 and thereby with the journal head 70 by the journal pressure spring 80 determines the extent to which the grinding roll 18 is spring biased into engagement with the coal on the grinding table 14, and concomitantly the amount of grinding force being applied to the coal by the grinding roll 18.

By way of exemplification, as the coal builds up on the grinding table 14, i.e., under the grinding roll 18, the journal head 70 is caused thereby to rotate in a counterclockwise direction, as viewed with reference to FIG. 1, about the pivot pin 36 which results in an increase in the spring force that is exerted by the mechanical coil spring system 20.

With further reference to the mechanical coil spring 20, which forms the subject matter of the present invention, such a mechanical coil spring system 20 is capable of being retrofitted as a substitute for prior art forms of hydraulic journal loading systems. Based on field test results, it is known that in some instances at least prior art forms of hydraulic journal loading systems have been found to cause unacceptable loading on the main vertical shaft of the bowl mill with which such hydraulic journal loading systems have been utilized. On the other hand, the mechanical coil spring system 20 constructed in accordance with the present invention has been found based on test results to produce lower loadings on the main vertical shaft of the bowl mill than do hydraulic journal loading systems. Moreover, it has been found that the mechanical coil spring system 20 of the present invention requires less maintenance and is simpler to operate. Finally, the mechanical coil spring system 20 constructed in accord with the present invention is further characterized by the fact that it successfully obviates some of the problems that have served to plague coil spring systems embodying earlier forms of construction. By way of exemplification and not limitation one such problem known to be associated with at least some earlier designs of spring journal loading systems for bowl mills has been that the spring of one spring system would fail and this in turn would result in imbalanced loading of the grinding rolls of the bowl mill. On the other hand, the mechanical coil spring system 20 constructed in accord with the present invention embodies two major improvements that reduce the possibility that the aforedescribed condition will occur. The first of these resides in the fact that the journal pressure spring 80 employed in mechanical coil spring system 20 of the present invention has been redesigned such as to provide the spring 80 with a much higher factor of safety against failure. Secondly, the mounting position of the journal pressure spring 80 has been moved such that the journal pressure spring 80 in contradistinction to prior art forms of spring journal loading systems is located almost completely externally of the separator body 12 of the bowl mill 10. A primary benefit of this is that the journal pressure spring 80 is no longer subject to the operating conditions that exist within the bowl mill 10. Heretofore, in the case of prior art designs of spring journal loading systems for bowl mills on occasion the heat buildup within the bowl mill would be sufficient to effectuate an annealing of the spring of the spring journal loading system. This annealing in turn would influence the spring's preset and fatigue strength characteristics. However, with the present positioning of the journal pressure spring 80 in accordance with the nature of the construction of the mechanical coil spring system 20 of the present invention, the journal pressure spring 80 is suitably located so as not to be exposed to sufficient heat that might otherwise effectuate an annealing of the journal pressure spring 80.

Thus, in accordance with the present invention there has been provided a new and improved system operable for establishing the journal loading of the grinding rolls of a bowl mill that is suitable for use to pulverize coal. Moreover, the system of the present invention is operative to establish a mechanical spring journal loading on the grinding rolls of a bowl mill suitable for use to pulverize coal. In addition, in accord with the present invention a mechanical spring system for establishing the journal loading on the grinding rolls of a bowl mill is provided that is capable of being utilized as a retrofit for a hydraulic journal loading system in an existing bowl mill. Further, the mechanical spring system of the present invention for establishing the journal loading on the grinding rolls of a bowl mill is characterized by the fact that lower forces are exerted thereby on the main vertical shaft of the bowl mill. Additionally, in accordance with the present invention the mechanical spring system for establishing the journal loading on the grinding rolls of a bowl mill is characterized by the fact that the spring portion thereof is suitably positioned such that minimal influence is exerted thereupon by the operating conditions which exist within the bowl mill. Also, the mechanical spring system of the present invention for establishing the journal loading on the grinding rolls of a bowl mill is characterized by the fact that less maintenance is required thereby. Furthermore, in accord with the present invention a mechanical spring system has been provided for establishing the journal loading on the grinding rolls of a bowl mill that is relatively simple to manufacture and operate, as well as being relatively inexpensive to provide.

While one embodiment of our invention has been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

What is claimed is:

1. A mechanical coil spring assembly for a bowl mill comprising:

(a) a preload stud means including a spring preload stud and a spring stud insert, said spring preload stud having an enlarged portion formed at one end thereof, said enlarged portion having a cavity formed therein, said spring stud insert being mounted within said cavity, said spring stud insert being operative to transmit therethrough the spring forces generated by the mechanical coil spring assembly;

(b) stud bearing housing means including a stud bearing housing, said stud bearing housing encircling said enlarged portion of said spring preload stud, said stud bearing housing first mounting means formed therein for use in securing the mechanical coil spring assembly on a bowl mill in mounted relation thereto;

(c) pressure spring means including a journal pressure spring supported in encircling relation to said spring preload stud, said journal pressure spring being operative to generate the spring forces provided by the mechanical coil spring assembly, said pressure spring means further including a spring stud adapter and a spring guide, said spring stud adapter being supported in encircling relation to said spring preload stud, said spring stud adapter forming one seat for said journal pressure spring, said spring guide being mounted in encircling relation to said spring preload stud, said spring guide forming the other seat for said journal pressure spring; and (d) said housing means including a spring housing and a housing adapter plate, said spring housing means further including means for securing said housing adapter plate to said spring housing, said spring housing encircling said journal pressure spring so as to provide an enclosure therefor, said housing adapter plate encircling said journal pressure spring, said housing adapter plate having second mounting means formed therein for use in securing the mechanical coil spring assembly on a bowl mill in mounted relation thereto, said spring housing means further including a spring housing cover and means for securing said spring housing cover to said spring housing, said spring housing cover encircling the other end of said spring preload stud.

2. The mechanical coil spring assembly as set forth in claim 1 further including a spring stud lock nut interposed between said spring housing cover and said other end of said spring preload stud in encircling relation to said other end of said spring preload stud, a stud lock nut keeper secured at said other end of said spring preload stud outwardly of said spring stud lock nut, a keeper washer positioned on said other end of said spring preload stud in engaging relation to said stud lock nut keeper, a nut secured at said other end of said spring preload stud outwardly of said keeper washer, and a lock nut keeper stud secured at said other end of said spring preload stud outwardly of said nut.

3. The mechanical coil spring assembly as set forth in claim 2 further including a stud extension cap secured to said spring housing cover so as to form an enclosure for said stud lock nut keeper, said keeper washer, said nut and said lock nut keeper stud.

4. The mechanical coil spring assembly as set forth in claim 1 further including adjustment means operative to adjust the amount of spring force generated by the mechanical coil spring assembly by varying the distance that said spring guide is spaced from said spring stud adapter, said adjustment means comprising a plurality of spring adjusting studs, each of said plurality of spring adjusting studs having one end threadedly engaged in said spring guide and having the other end accessible from the exterior of the mechanical coil spring assembly.

* * * * *